US010484778B2

(12) United States Patent
Fukutsuka et al.

(10) Patent No.: US 10,484,778 B2
(45) Date of Patent: Nov. 19, 2019

(54) HEADSET

(71) Applicant: Panasonic Intellectual Property Management Co., Ltd., Osaka (JP)

(72) Inventors: Hirotaka Fukutsuka, Fukuoka (JP); Shinji Kuraoka, Fukuoka (JP); Ryota Fujii, Fukuoka (JP); Koji Ikeda, Fukuoka (JP)

(73) Assignee: PANASONIC INTELLECTUAL PROPERTY MANAGEMENT CO., LTD., Osaka (JP)

( * ) Notice: Subject to any disclaimer, the term of this patent is extended or adjusted under 35 U.S.C. 154(b) by 0 days.

(21) Appl. No.: 16/100,616

(22) Filed: Aug. 10, 2018

(65) Prior Publication Data

US 2019/0132667 A1 May 2, 2019

(30) Foreign Application Priority Data

Oct. 30, 2017 (JP) ..... 2017-209621

(51) Int. Cl.
*H04R 1/00* (2006.01)
*H04R 1/10* (2006.01)
*H04R 1/08* (2006.01)

(52) U.S. Cl.
CPC ..... *H04R 1/1041* (2013.01); *H04R 1/08* (2013.01); *H04R 1/105* (2013.01); *H04R 1/1008* (2013.01); *H04R 2201/107* (2013.01)

(58) Field of Classification Search
CPC ..... H04R 2201/107; H04R 5/033
See application file for complete search history.

(56) References Cited

U.S. PATENT DOCUMENTS 6,430,299 B1 8/2002 Hall et al.
7,031,475 B2 * 4/2006 Kuraoka ..... H04M 1/0289 379/428.02
8,693,703 B2 * 4/2014 Rung ..... G10L 21/0208 367/121
9,036,849 B2 * 5/2015 Thompson ..... H04R 1/083 381/122
10,225,674 B2 * 3/2019 Olsson ..... G10L 21/0216
2008/0201138 A1 * 8/2008 Visser ..... G10L 21/0208 704/227
2010/0040245 A1 * 2/2010 Buil ..... H04M 1/05 381/107

(Continued)

FOREIGN PATENT DOCUMENTS

JP 2003-528434 9/2003

*Primary Examiner* — Matthew A Eason
(74) *Attorney, Agent, or Firm* — Wenderoth, Lind & Ponack, L.L.P.

(57) ABSTRACT

A headset includes a housing provided at one end of a headband, an ear pad attached to the housing, a boom main body attached to the housing on a side opposite to the ear pad, an arm portion provided in the boom main body and protruding to a side opposite to one end of the headband with the housing interposed between the headband and the arm portion, a first microphone provided at a protruding tip of the arm portion, and a second microphone provided on the arm portion, and disposed on a substantially straight line passing through a mouth of a user and the first microphone and on a side opposite to the mouth of the user with the first microphone interposed between the mouth and the second microphone.

6 Claims, 14 Drawing Sheets

(56) References Cited

U.S. PATENT DOCUMENTS

| | | | | |
|---|---|---|---|---|
| 2012/0244801 | A1* | 9/2012 | Lau | H04B 5/0006 455/41.1 |
| 2015/0003623 | A1* | 1/2015 | Rasmussen | G10K 11/002 381/71.6 |
| 2018/0091882 | A1* | 3/2018 | Christiansen | H04R 1/083 |

* cited by examiner

HEADSET

BACKGROUND

1. Technical Field

The present disclosure relates to a headset used by being worn on a human head.

2. Description of the Related Art

A headset equipped with a speaker and a microphone and used by being worn on a human head is known. For example, a headset described in Published Japanese Translation No. 2003-528434 of the PCT International Publication is configured to include a headband and an electronic device housing. The electronic device housing is provided with an earphone speaker, a microphone boom, a touch pad for operating the headset electronic device, and the like. The microphone boom is attached to the electronic device housing so that the microphone boom can be adjusted to a comfortable position. The microphone boom protrudes from the electronic device housing and has a microphone at a tip which can be placed at the mouth.

However, since the headset in the related art such as the above document has only a single microphone at the tip of the microphone boom, sound collecting performance (that is, sound quality of sound collected by microphone) may be deteriorated according to the surrounding noise condition. In order to enhance the sound collecting performance of the headset, for example, it is conceivable to make the microphone boom longer so that the microphone can be disposed at the mouth, but there was a problem that the microphone boom became large and it was difficult to reduce the weight. When it is difficult to reduce the weight of the headset, there are discomfort for use and inconvenience in an operation of using the headset for a long time (for example, clerk of fast food), and usability is not good.

SUMMARY

The disclosure has been devised in view of the above-described circumstances in the related art, and it is an object to provide a headset compatible with improving the sound collecting performance so that the sound can be clearly heard even in a noisy environment and reducing the weight.

The disclosure provides a headset including a housing provided at one end of a headband, an ear pad attached to the housing, a boom main body attached to the housing on a side opposite to the ear pad, an arm portion provided in the boom main body and protruding to a side opposite to one end of the headband with the housing interposed between the headband and the arm portion, a first microphone provided at a protruding tip of the arm portion, and a second microphone provided on the arm portion, and disposed on a substantially straight line passing through a mouth of a user and the first microphone and on a side opposite to the mouth of the user with the first microphone interposed between the mouth and the second microphone.

According to the disclosure, it is possible to obtain the headset compatible with improving the sound collecting performance so that the sound can be clearly heard even in a noisy environment and reducing the weight.

DETAILED DESCRIPTION

Hereinafter, referring to drawings as appropriate, an exemplary embodiment (hereinafter referred to as the exemplary embodiment) in which a headset according to the disclosure is specifically disclosed will be described in detail. However, detailed explanation may be omitted more than necessary. For example, detailed explanations of already well-known matters or redundant explanations on substantially the same configuration may be omitted. This omission is to avoid unnecessary redundancy of the following description and to facilitate understanding by those skilled in the art. The accompanying drawings and the following description are provided to enable those skilled in the art to fully understand the disclosure and are not intended to limit the claimed subject matter by these drawings and description.

Figure 1:
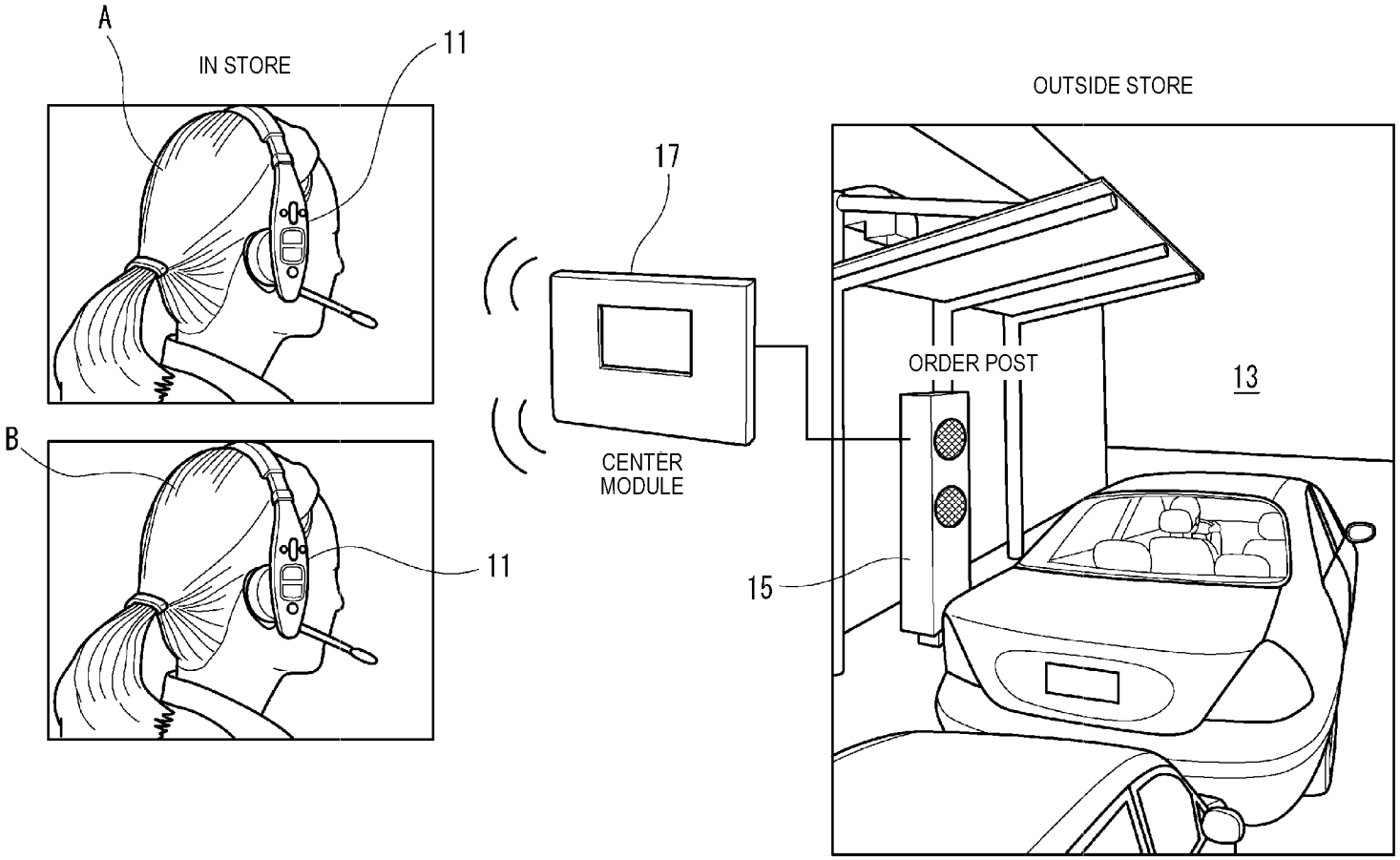
FIG. 1 is a view illustrating a system configuration example of an order system of a fast food store using a headset according to this exemplary embodiment.

FIG. 1 is a view illustrating a system configuration example of an order system of a fast food store using headset 11 according to this exemplary embodiment.

The order system of the fast food store illustrated in FIG. 1 is configured to include one headset 11 or more, one order post 15 or more, and center module 17.

Headset 11 can be used extensively in various industries such as fast food industry, banking industry, retail industry, and the like. For example, in the fast food store, in order to receive an order over a vehicle from a customer (that is, a driver of a vehicle) who visited existing drive-through lane 13 in the site of the fast food store, a plurality of employees have respectively different headsets 11 and respond to orders.

For example, in the fast food store having a plurality of drive-through lanes 13, order post 15 is installed in each of drive-through lanes 13. Order post 15 is provided with a microphone for collecting voice emitted from the driver of the vehicle and a speaker for outputting voice generated by a clerk (in other words, employee).

Center module 17 is installed in the store.

Center module 17 mainly is provided with an interface unit for communication, a processor, a memory, and the like, and transmits or receives (relays) a voice data of the employee in the store wearing headset 11 and a voice data of the customer outside the store using wireless communication. As the communication method, for example, 1.9 GHz band digital enhanced cordless telecommunications (DECT) or the like which is a communication standard of a digital cordless telephone is used. The clerk (in other words, employee) can choose which customers of order post 15 to talk to. For example, in a case where two lanes 1 and 2 are arranged in parallel as drive-through lane 13, the clerk (in other words, employee) can switch a call destination to either lanes 1 or 2 by double-clicking a shift button (described later) of headset 11. In addition, center module 17 can relay calls between employees A and B who are respectively in charge of different drive-through lanes 13 (lanes 1 and 2), for example, as store clerks (in other words, employees) in the store.

Figure 2:
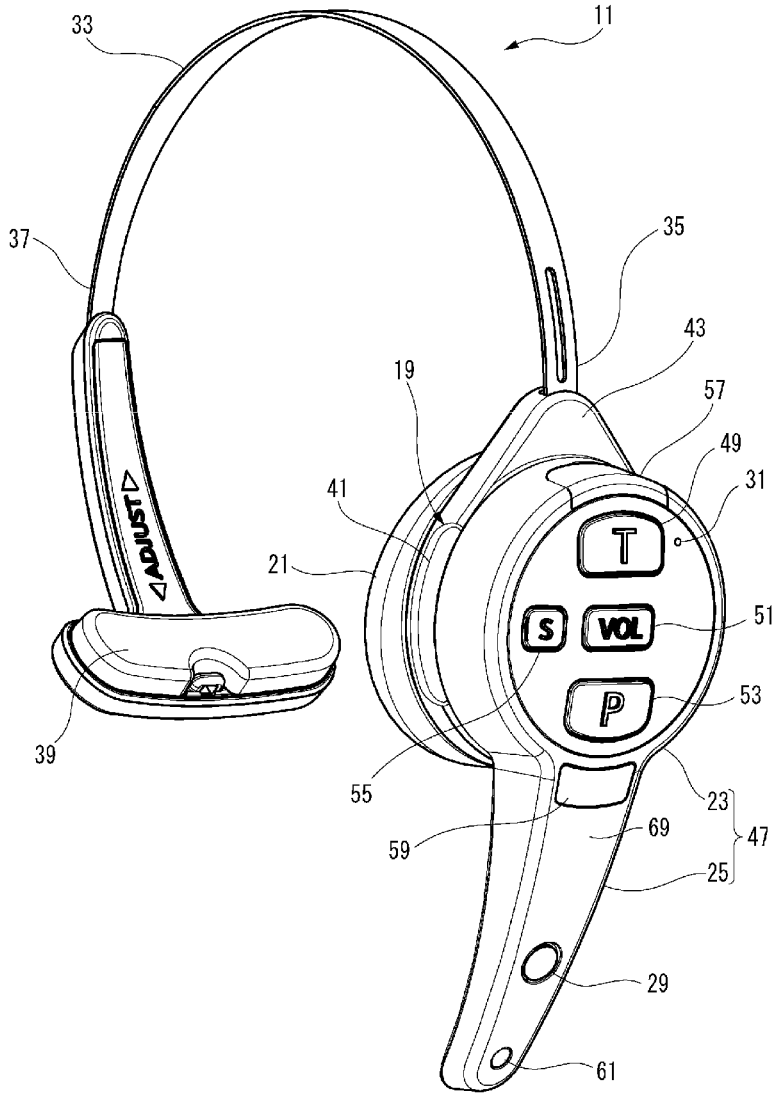
FIG. 2 is a perspective view of the headset illustrated in FIG. 1.

FIG. 2 is a perspective view of headset 11 illustrated in FIG. 1. Headset 11 according to the exemplary embodiment has housing 19, ear pad 21, boom main body 23, arm portion 25, first microphone 27, and second microphone 29 as main components. In addition, in the exemplary embodiment, headset 11 may further include third microphone 31 as a main component.

Housing 19 is provided at one end 35 of headband 33. Head pad 39 is provided on another end 37 of headband 33. Housing 19 is formed in a tear drop shaped plate by circular portion 41 and protrusion portion 43. In headset 11, another end 37 of headband 33 is connected to head pad 39 so as to advance and retreat, and a length of headband 33 can be adjusted according to a size of the wearer's head.

Ear pad 21 is attached to a surface of circular portion 41 facing head pad 39. An angle of ear pad 21 with respect to the ear can be adjusted by rotating. At a center portion of ear pad 21, there is formed opening 45 through which a speaker sound is emitted (refer to FIG. 3). A speaker housed in boom main body 23 is disposed in communication with a rear surface of opening 45. When a user hangs headband 33 on the head, head pad 39 presses one side head portion and ear pad 21 is disposed on the other ear so that head pad 39 is attached.

Microphone boom 47 is rotatably attached to housing 19 on the side opposite to ear pad 21. Microphone boom 47 is integrally formed by boom main body 23 and arm portion 25. The Boom main body 23 is formed in a flat cylindrical shape. Boom main body 23 rotates at the same center as circular portion 41 of housing 19.

On a front surface of boom main body 23, a plurality of switches are provided. These switches include, for example, talk button 49, volume control button 51, page button 53, shift button 55, and the like.

Talk button 49 is a button for talking with a customer in front of order post 15. For example, if talk button 49 is pressed once, a call can be made with a customer (that is, a customer in a vehicle) in the vicinity of order post 15 of the currently connected drive-through lane, and if talk button 49 is pressed again, the call is ended.

In volume control button 51, when the button is pressed, the volume increases. A beep tone sounds when it reaches an upper limit of the volume, and it returns to a lower limit of the volume when the button is again pushed.

Page button 53 controls calls between employees. When page button 53 is pressed once, a call can be made with the clerk (in other words, employee) who is in charge of the currently connected drive-through lane, and when page button 53 is pressed again, the call is ended. The operation of page button 53 changes depending on the setting operation on headset 11.

Various functions can be used by pushing shift button 55 or simultaneously pressing shift button 55 and another button. For example, it is possible to switch the drive-through lane of the connection destination and to notify the alert by using shift button 55.

In addition, on the outer periphery of boom main body 23, color chip 57 is detachably provided. Color chip 57 enables color separation of headset 11 by replacing color chip 57, and usability at the time of operation in which each of the plurality of different headsets 11 by the plurality of clerks are actually used can be improved.

In addition to this, indicator lamp 59 and lane indicator lamp 61 are provided on boom main body 23. In indicator lamp 59, power indicator lamp 63 (refer to FIG. 7) and setting indicator lamp are disposed. Lane indicator lamp 61 represents the drive through lane to which headset 11 is connected by the lighting color.

Arm portion 25 is provided on boom main body 23 and protrudes to the side opposite to one end 35 of headband 33 with housing 19 interposed therebetween. Arm portion 25 is formed in a curved pyramid shape so that a protruding tip along the cheeks faces the mouth when the clerk (in other words, employee) wears. The inside of arm portion 25 is electrical component housing 65 (refer to FIG. 5) communicating with boom main body 23.

Figure 3:
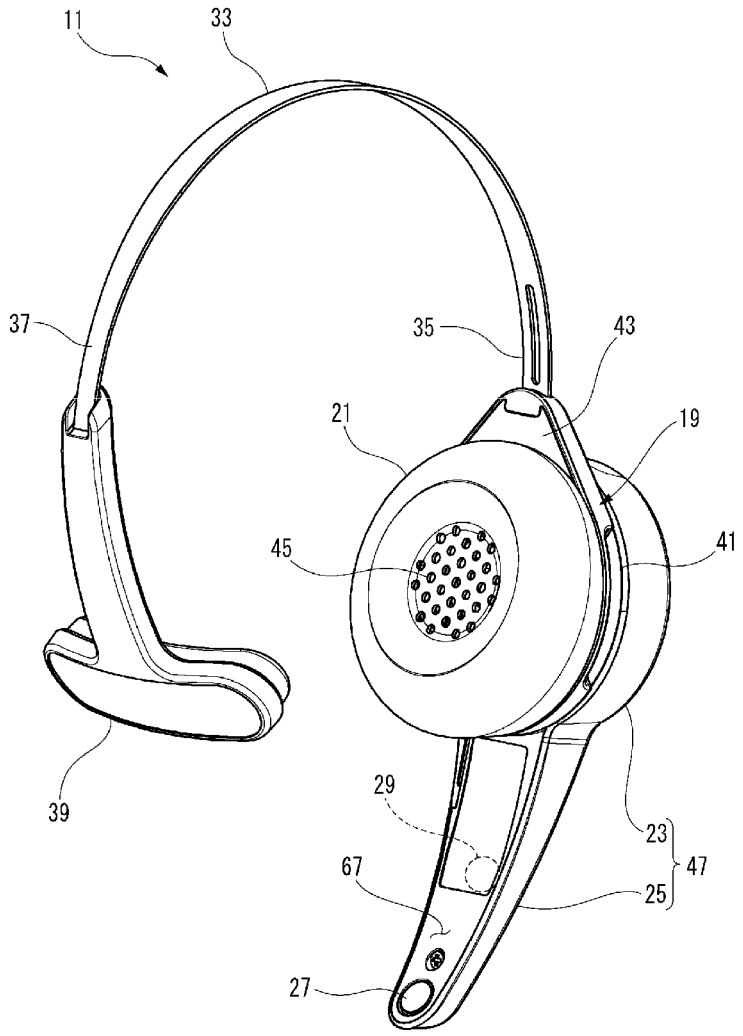
FIG. 3 is a perspective view of the headset of FIG. 2 as viewed from a rear side.

FIG. 3 is a perspective view of headset 11 of FIG. 2 as viewed from a rear side. First microphone 27 is provided at the protruding tip of arm portion 25. First microphone 27 is disposed on the arm inner surface 67 facing the mouth of the user at the protruding tip of arm portion 25.

Figure 4:
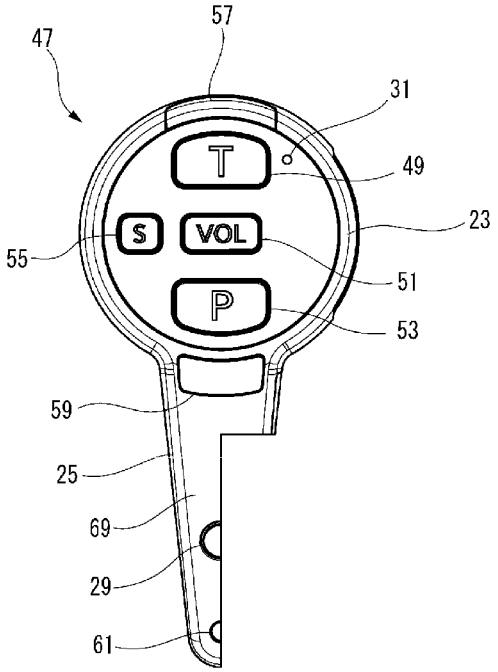
FIG. 4 is a front view of a microphone boom with a portion of an arm portion cut away.

FIG. 4 is a front view of microphone boom 47 with a portion of arm portion 25 cut away. In headset 11, first microphone 27 is disposed on arm inner surface 67 facing the mouth side of arm portion 25, as described above. On the other hand, second microphone 29 is provided on arm portion 25. Second microphone 29 is disposed on arm outer surface 69 of arm portion 25 opposite to arm inner surface 67.

Figure 5:
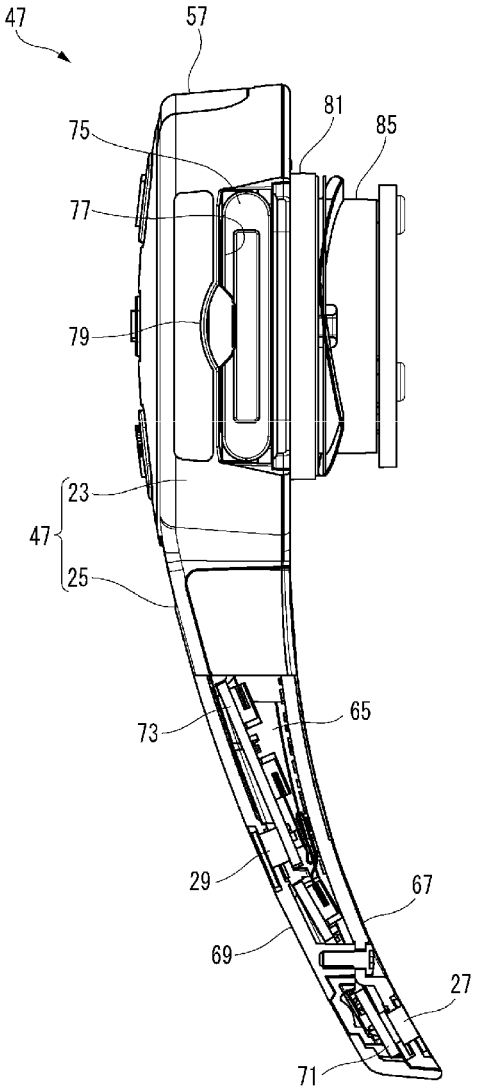
FIG. 5 is a side view of the microphone boom illustrated in FIG. 4.

FIG. 5 is a side view of microphone boom 47 illustrated in FIG. 4. Microphone mounting board 71 on which first microphone 27 is mounted is housed at the protruding tip of electrical component housing 65. Microphone mounting board 73 on which second microphone 29 is mounted is housed in electrical component housing 65 between microphone mounting board 71 and boom main body 23.

In headset 11, third microphone 31 is further disposed on arm outer surface 69 which is a side opposite to first microphone 27 with second microphone 29 interposed therebetween on boom main body 23 or arm portion 25. In the exemplary embodiment, as illustrated in FIG. 2, third microphone 31 is provided in the vicinity of talk button 49 in boom main body 23.

In headset 11, the distance between second microphone 29 and third microphone 31 is set longer than the distance between first microphone 27 and second microphone 29.

For these first microphone 27, second microphone 29, and third microphone 31, for example, a non-directional microphone as micro electro mechanical systems (MEMS) microphones are used. In headset 11, by using a plurality of non-directional microphones (mainly first microphone 27 and second microphone 29), it is easy to form directivity in audio signal processor 91 described later. It goes without saying that the use of third microphone 31 does not exclude the formation of the directivity in audio signal processor 91 described later. In addition, in headset 11, the microphones can be mounted by reflowing to microphone mounting board 71 and microphone mounting board 73 by using the non-directional microphones for first microphone 27, second microphone 29, and third microphone 31. As a result, headset 11 is improved in productivity.

Boom main body 23 is provided with battery housing 77 for housing battery 75. When battery 75 is inserted into battery housing 77, battery 75 is held by battery lock 79. Battery 75 can be removed by pressing battery lock 79.

Shaft portion 81 coaxial with a rotation center is formed on boom main body 23. Boom main body 23 is rotatably supported by inserting shaft portion 81 into circular portion 41 of housing 19. The detachment of shaft portion 81 with respect to housing 19 is regulated by a locking structure (not illustrated). Speaker housing tube 85 housing speaker 83 (refer to FIG. 11) is formed on shaft portion 81. Speaker housing tube 85 penetrates circular portion 41 of housing 19 and faces opening 45 of ear pad 21. Speaker housing tube 85 allows the sound from speaker 83 to be output from ear pad 21 by having a tip end opening facing opening 45 of ear pad 21. In this manner, in headset 11, entire of the electrical components are housed in boom main body 23.

Figure 6:
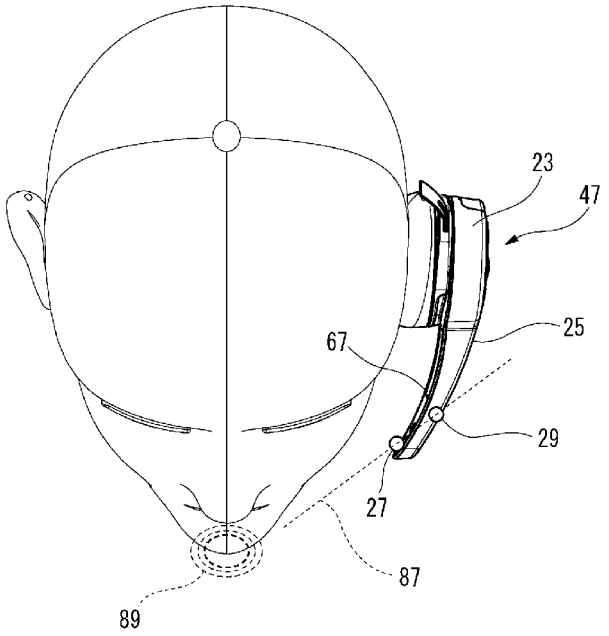
FIG. 6 is an explanatory view illustrating an example of a positional relationship between a mouth, a first microphone, and a second microphone.

FIG. 6 is an explanatory view illustrating an example of a positional relationship between a mouth, first microphone 27, and second microphone 29. When the clerk (in other words, employee) as a user wears the headset 11, in headset 11, second microphone 29 is disposed on a substantially straight line passing through the mouth of the clerk (in other words, employee) and first microphone 27, and on the side opposite to the mouth with first microphone 27 interposed therebetween. In other words, first microphone 27 and second microphone 29 are disposed so that imaginary straight line 87 connecting second microphone 29 and first microphone 27 passes through the mouth of the clerk (in other words, employee). The mouth of the clerk (in other words, employee) is, for example, sound collecting area 89 which is an entrance and exit of a sound of a front lip of the clerk (in other words, employee).

Here, an example of generation processing of an audio signal according to a microphone arrangement example of headset 11 according to the exemplary embodiment will be described.

In headset 11, audio signal processor 91 (refer to FIG. 11) generates a signal (audio signal serving as main signal) having directivity in a direction toward the mouth of the clerk (in other words, employee), for example, using two first microphone 27 and second microphone 29. In addition, audio signal processor 91 generates a signal (reference signal) having a directivity in a null direction with respect to a direction (in other words, direction deviating from direction toward mouth described above) not facing the mouth of the clerk (in other words, employee) who is a user, for example.

The Headset 11 calculates the generation processing of the audio signal described above in a frequency domain. For ease of explanation, processing contents in the time domain are described here. In a case where an audio signal input from first microphone 27 is $x_0$ (t) and an audio signal input from second microphone 29 is $x_1$ (t), a main signal $x_{main}$ (t) derived by calculation is as indicated in Equation (1).

[Math 1]

$$x_{main}(t)=x_0(t)-x_1(t-d) \quad (1)$$

In Equation (1), d represents the time difference at which the sound arrives from second microphone 29 to first microphone 27. For example, in a case where the distance between first microphone 27 and second microphone is 20 mm, the time difference is 0.02 m÷334 m/s=0.059 ms, and in a case of processing at fs=16 kHz, d is approximately 1 sample since one sample is 0.0625 ms. In order to more accurately adjust the phase difference, it is necessary to perform calculation at a high sampling rate or convert the time difference to frequency domain. In the generation processing of the audio signal in headset 11, the time difference is converted into the frequency domain.

Figure 7:
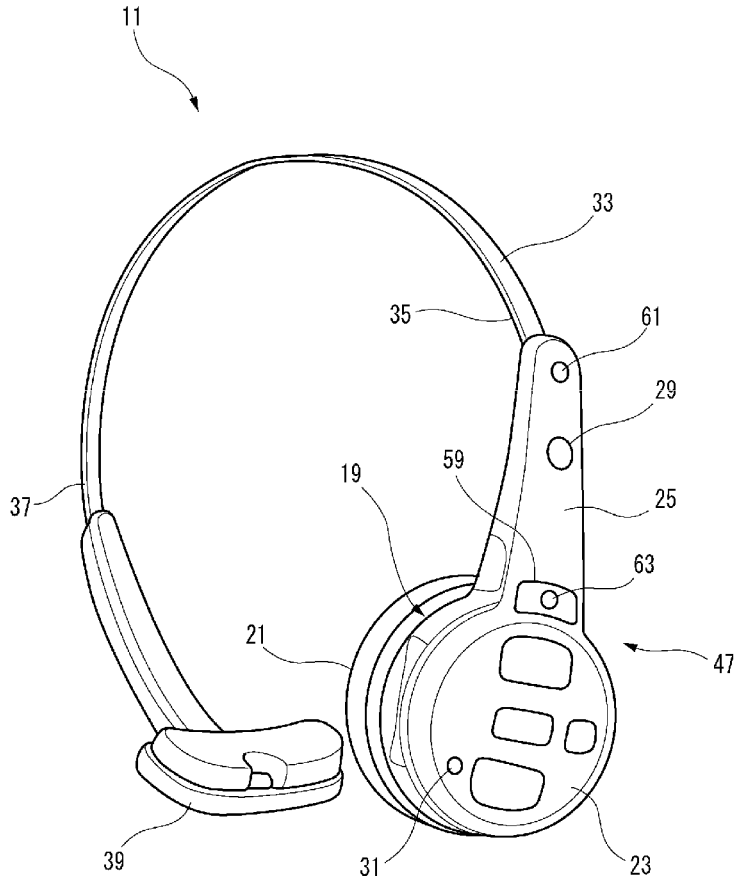
FIG. 7 is a perspective view of the headset when not in use.

FIG. 7 is a perspective view of headset 11 when not in use. In headset 11, boom main body 23 and arm portion 25 are provided so as to be integrally rotatable with respect to housing 19 as described above. In headset 11, power source switch 93 (refer to FIG. 11) is turned off at a rotational position illustrated in FIG. 7 where arm portion 25 is overlapped on headband 33.

Figure 8:
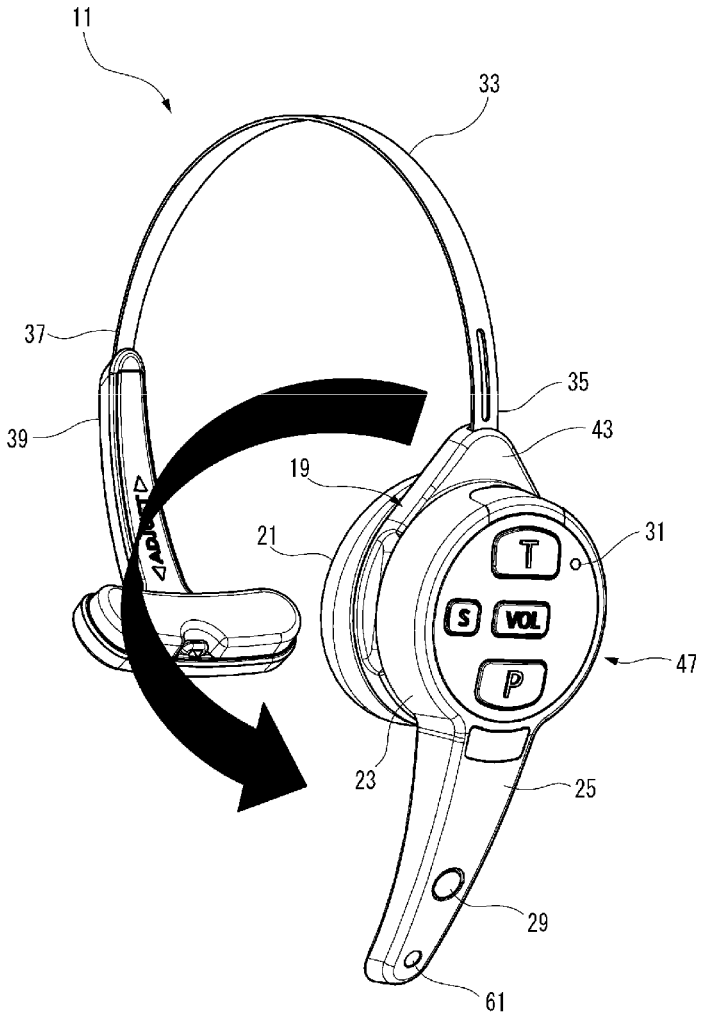
FIG. 8 is a perspective view of the headset in which the microphone boom is rotated in a circumferential direction to be usable.

FIG. 8 is a perspective view of headset 11 in which microphone boom 47 is rotated in a circumferential direction to be usable. In addition, in headset 11, power source switch 93 is turned on at a rotational position illustrated in FIG. 8 where arm portion 25 protrudes to a side opposite to one end 35 of headband 33 with housing 19 interposed therebetween.

Figure 9:
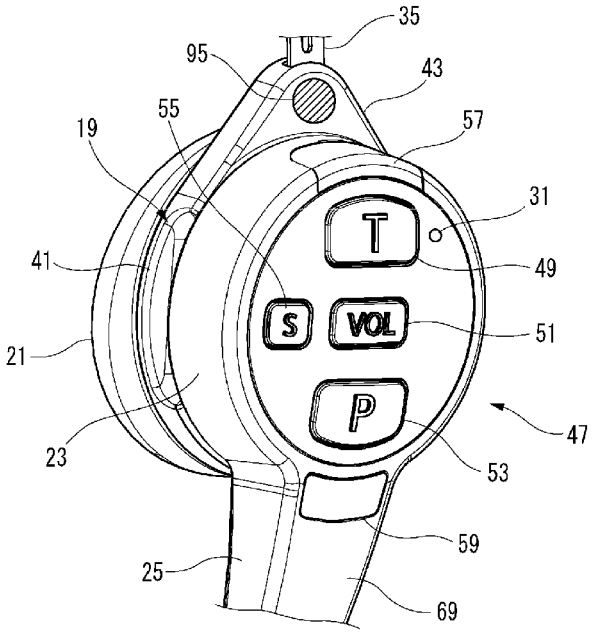
FIG. 9 is an enlarged perspective view of a main part illustrating a position of a magnet provided in a housing.

FIG. 9 is an enlarged perspective view of a main part illustrating a position of magnet 95 provided in housing 19. Magnet 95 is built in protrusion 43 of housing 19 on the outer surface side (surface on side opposite to head when worn by a user).

Figure 10:
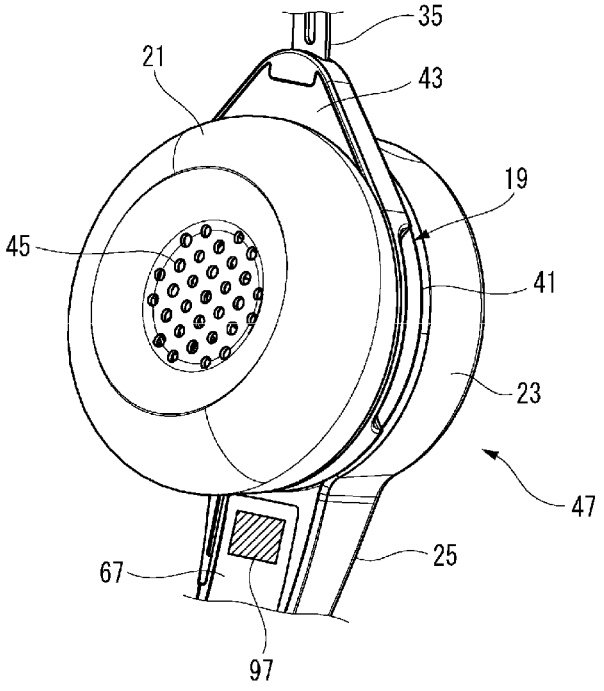
FIG. 10 is an enlarged perspective view of a main part illustrating a position of a Hall IC provided in the arm portion.

FIG. 10 is an enlarged perspective view of a main part illustrating a position of Hall IC 97 provided in arm portion 25. At a base of arm portion 25, Hall IC 97 is provided on arm inner surface 67. When microphone boom 47 is rotated and coincides with the position of magnet 95, Hall IC 97 performs the power off operation. In headset 11, the power supply is turned on or off in a non-contact manner by magnet 95 and Hall IC 97. Therefore, as compared with a configuration using a switch having a contact, durability can be improved.

Figure 11:
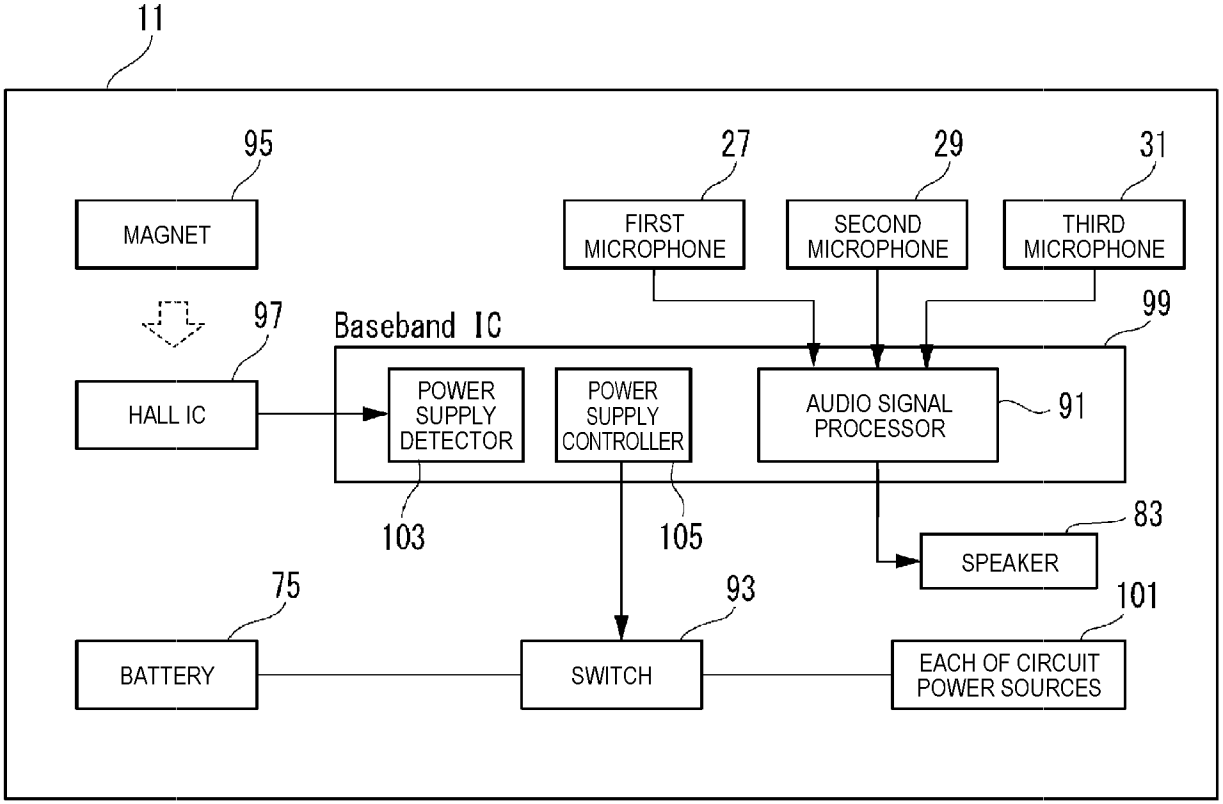
FIG. 11 is a block diagram illustrating an example of an internal configuration of the headset for realizing to turn on or off power supply of the headset by a rotation structure of the microphone boom.

FIG. 11 is a block diagram illustrating an example of an internal configuration of headset 11 for realizing to turn on or off power supply of headset 11 by a rotation structure of the microphone boom. Headset 11 adopts a microphone boom rotation structure and includes magnet 95, Hall IC 97, baseband IC 99, battery 75, switch 93, speaker 83, each of circuit power sources 101 as a control structure for turning on or off the power supply of headset 11 itself by the microphone boom rotation structure.

Baseband IC 99 includes power supply detector 103, power supply controller 105, and audio signal processor 91. Power supply detector 103 detects a signal output from Hall IC 97 that operates by approaching or separating from Hall IC 97 of magnet 95. Power supply controller 105 outputs a control signal (ON or OFF control signal) for instructing switch 93 to turn on or off the power supply of headset 11 based on a signal output from power supply detector 103. Switch 93 feeds power supply (power ON) from battery 75 to each circuit power source 101, and stops power supply from battery 75 to each circuit power source 101 (power OFF) based on the ON or OFF control signal.

For example, audio signal processor 91 generates a signal having directivity in a direction toward the mouth of the clerk (in other words, employee) who is a user based on audio signals input from first microphone 27, second microphone 29, and third microphone 31. That is, the main signal and the reference signal in the above processing are generated. Audio signal processor 91 suppresses noise and transmits clear sound to speaker 83 based on the main signal and the reference signal.

Next, the operation of the configuration of headset 11 will be described.

Headset 11 according to the exemplary embodiment is provided with housing 19 provided at one end of headband 33, ear pad 21 attached to housing 19, boom main body 23 attached to housing 19 on the side opposite to ear pad 21, arm portion 25 provided on boom main body 23 and protruding to the side opposite to one end 35 of headband 33 with housing 19 interposed therebetween, first microphone 27 provided at the protruding tip of arm portion 25, and second microphone 29 provided on arm portion 25 and disposed on a substantially straight line passing through the mouth of the user and first microphone 27 and on the side opposite to the mouth of the user with first microphone 27 interposed therebetween.

In headset 11 according to the exemplary embodiment, for example, second microphone 29 is disposed on a substantially straight line passing through the mouth of the clerk (in other words, employee) who is the user and first microphone 27, on the opposite side of the mouth of the clerk (in other words, employee), with first microphone 27 interposed therebetween. That is, in headset 11, first microphone 27 and second microphone 29 are disposed on a substantially straight line in the order of closeness to the mouth. Headset 11 performs sound detection of the user with two first microphone 27 and second microphone 29 of different distances apart from the mouth. In addition, headset 11 can control the directivity with respect to the mouth with first microphone 27 and second microphone 29 together with sound detection. Compared with a single microphone configuration, headset 11 can facilitate continuous ambient noise suppression. Therefore, headset 11 is compatible with improving the sound collecting performance so that the sound can be clearly heard even in a noisy environment and reducing the weight, for example.

Figure 12:
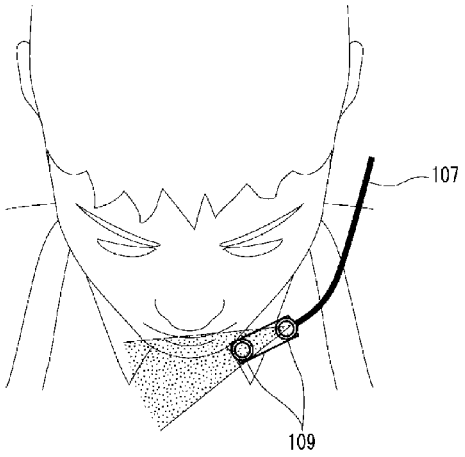
FIG. 12 is an explanatory view of a comparative example in which a plurality of microphones are provided on a long arm portion.
Figure 13:
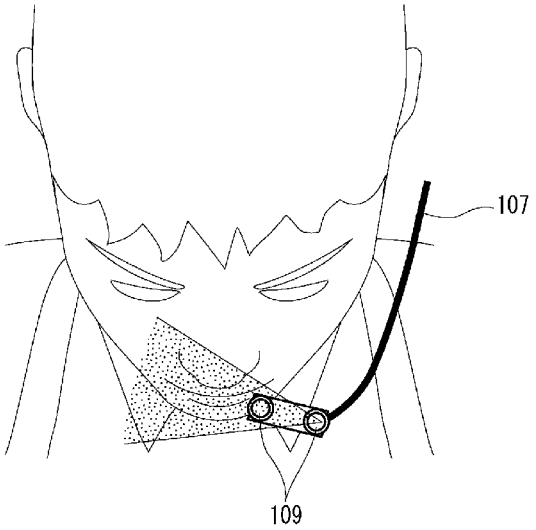
FIG. 13 is an explanatory view of a comparative example in which the plurality of microphones are provided on a substantially straight line passing through a mouth on the long arm portion.

FIG. 12 is an explanatory view of a comparative example in which a plurality of microphones 109 are provided on long arm portion 107. FIG. 13 is an explanatory view of a comparative example in which the plurality of microphones 109 are provided on a substantially straight line passing through a mouth on long arm portion 111.

Generally, in order to enhance the sound collecting performance, it is also considered to allow arm portion 107 of the microphone boom long so that microphone 109 can be arranged at the mouth as in the headset of the comparative example illustrated in FIG. 12. In addition, in order to dispose the plurality of microphones 109 on the substantially straight line in order of closeness to the mouth, it is also considered to allow arm portion 111 longer as illustrated in FIG. 13. However, in this case, the size of the microphone boom is increased and there is a problem that it is difficult to reduce the weight.

On the other hand, as illustrated in FIG. 6, since headset 11 according to the exemplary embodiment has a configuration in which first microphone 27 and second microphone 29 are disposed on a substantially straight line passing through the mouth, so that the directivity control with respect to the mouth can be performed. In order to enhance the sound collecting performance, it is unnecessary to lengthen microphone boom 47 to dispose the microphone at the mouth. Therefore, the weight can be reduced by shortening microphone boom 47. By reducing the weight, it can be unlikely to be tired even when wearing headset 11 during work.

Figure 14:
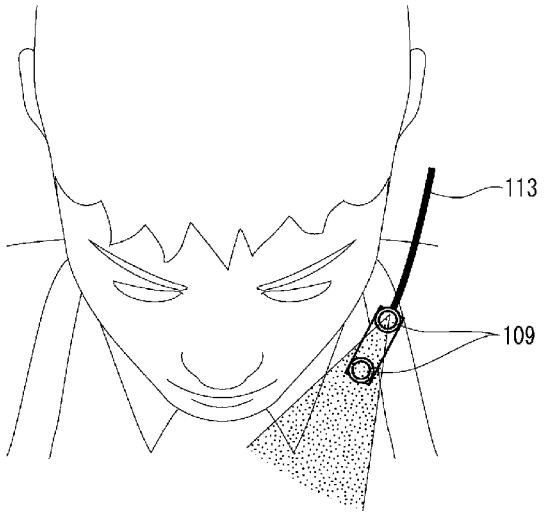
FIG. 14 is an explanatory view of a comparative example in which the plurality of microphones are provided on a short arm portion.

FIG. 14 is an explanatory view of a comparative example in which the plurality of microphones 109 are provided on short arm portion 113. Even if the plurality of microphones 109 are simply provided on short arm portion 113 as in the headset according to the comparative example illustrated in FIG. 14 in order to reduce the weight, the directivity is not directed to the mouth of the user in the configuration in which the plurality of microphones 109 cannot be disposed on a substantially straight line passing through the mouth.

In addition, in headset 11, first microphone 27 is disposed on arm inner surface 67 facing the mouth side of arm portion 25, and second microphone 29 is disposed on arm outer surface 69 of arm portion 25 opposite to arm inner surface 67.

As a result, in headset 11, first microphone 27 and second microphone 29 are disposed on the front and rear sides of arm portion 25 opposite to each other, so that it is possible to secure a large separation distance between the microphones as compared with the configuration in which first microphone 27 and second microphone 29 are disposed side by side on the same surface. As a result, sharp directivity can be formed on arm portion 25 of a limited length.

In addition, headset 11 is further provided with audio signal processor 91 for generating a signal having directivity in a direction toward the mouth of the user based on audio signals collected by first microphone 27 and second microphone 29.

As a result, in headset 11, audio signal processor 91 generates the main signal using two first microphone 27 and second microphone 29. Therefore, clear sound can be reproduced by the main signal having sharp directivity. In addition, audio signal processor 91 can generate a reference signal having directivity in the null direction. By using the reference signal, noise other than the voice of the user can be suppressed.

As a caution at this time, since the directivity of the main signal is generated on the extension line from second microphone 29 to first microphone 27, it is desirable that there is a mouth near the line. In the microphone disposition of the comparative example illustrated in FIG. 14, directivity may not be directed to the mouth of the user in some cases.

In addition, headset 11 is further provided with third microphone 31 disposed on arm outer surface 69 of arm portion 25, which is on the side opposite to first microphone 27 with second microphone 29 interposed therebetween.

Figure 15:
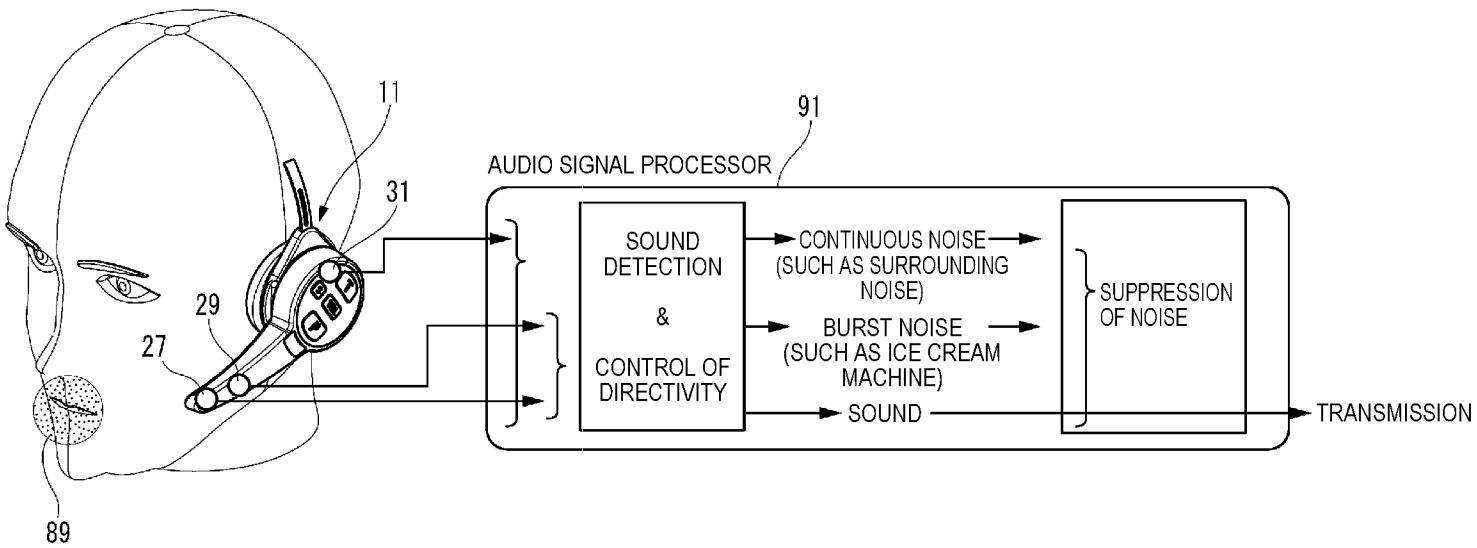
FIG. 15 is a schematic overview of an operation of the headset.

FIG. 15 is a schematic overview of an operation of headset 11. In addition, in headset 11, first microphone 27, second microphone 29, and third microphone 31 are used, so that noise can be suppressed. Based on the audio signals from these three microphones, in headset 11 sound, continuous noise (environmental sound), and sudden sound (burst noise) can be estimated, and only sound can be emphasized by audio signal processor 91. As burst noise, for example, there is an operation sound of an ice cream machine. In particular, by using the audio signal from third microphone 31, it is possible to impart high noise suppression performance against sudden noise in addition to the environmental sound suppression performance which can be achieved with the configuration of only first microphone 27 and second microphone 29. As a result, headset 11 is adapted to cope with both continuous and burst noise while enabling clear sound transmission.

More specifically, in the prototype of headset 11 having this configuration, the measurement result that the noise suppression amount is 24 dB or more is obtained as compared with the current product of 24 dB maximum.

In addition, in headset 11, the distance between second microphone 29 and third microphone 31 is longer than the distance between first microphone 27 and second microphone 29.

As a result, in headset 11, third microphone 31 is disposed on arm outer surface 69 away from first microphone 27 and second microphone 29, so that it is easy to collect external sudden sounds. Third microphone 31 is disposed away from first microphone 27 and second microphone 29, so that it is easy to obtain a burst noise signal with strong directivity.

In addition, headset 11 is further provided with power supply controller 105 that turns off power supply of headset 11 when it is detected that arm portion 25 is rotated to a position where arm portion 25 overlaps headband 33 in accordance with the rotation of arm portion 25 with respect to housing 19.

As a result, in headset 11, the OFF state of the power supply can be easily recognized from all directions by visual sense or tactile sensation, depending on the rotational position of arm portion 25 overlapping with headband 33. In addition, when the power supply is turned off, that is, when headset 11 is not in use, protruding arm portion 25 overlaps with headband 33 and does not protrude. As a result, headset 11 can be compactly folded and stored in a space-saving manner.

In addition, in headset 11, boom main body 23 and arm portion 25 are integrally rotatable with respect to housing 19 fixed to headband 33. Therefore, all the electrical components such as speaker 83, the microphone, the switches, the indicator lamp, the board, battery 75, the cable, and the like can be stored in boom main body 23 and arm portion 25. As a result, in headset 11, the cable is not wired across the movable member, disconnection is unlikely to occur, and the cable is unlikely to be broken.

In addition, headset 11 is further provided with power supply controller 105 that turns on power supply of headset 11 when it is detected that arm portion 25 is rotated to a position where arm portion 25 protrudes to a side opposite to one end 35 of headband 33 with housing 19 interposed therebetween, in accordance with rotation of arm portion 25 with respect to housing 19.

As a result, in headset 11, the ON state of the power supply can be easily recognized from all directions by visual sense or tactile sensation, depending on the rotational position of arm portion 25.

Therefore, according to headset 11 according to the exemplary embodiment, it is possible to obtain lightweight headset 11 in which the sound can clearly be heard even in a noisy environment.

Although the exemplary embodiment according to the disclosure has been described with reference to the drawings, it goes without saying that the disclosure is not limited to such an example. It is understood that it is apparent to those skilled in the art that various modified examples or correction examples can be conceived, and naturally belong to the technical scope of the disclosure within the scope described in the aspects. In addition, each component in the above-described exemplary embodiment may be arbitrarily combined within the scope not deviating from the gist of the disclosure.

What is claimed is:

1. A headset comprising:

a housing at a first end of a headband;

an ear pad attached to the housing;

a boom main body attached to the housing on a side opposite to the ear pad;

an arm portion in the boom main body and protruding to a side opposite to the first end of the headband with the housing interposed between the headband and the arm portion;

a first microphone at a protruding tip of the arm portion; and a second microphone on the arm portion, the second microphone being disposed on a substantially straight line passing through a mouth of a user and the first microphone and on a side of the arm portion opposite to the mouth of the user with the first microphone interposed between the mouth and the second microphone;

wherein the first microphone is disposed only on an arm inner surface at a mouth side of the arm portion, and the second microphone is disposed only on an arm outer surface of the arm portion at a side opposite to the arm inner surface.

2. The headset of claim 1, further comprising an audio signal processor configured to generate a signal having directivity in a direction toward the mouth of the user based on audio signals collected respectively by the first microphone and the second microphone.

3. The headset of claim 1, further comprising a third microphone disposed on the arm outer surface of the arm portion at a side opposite to the first microphone with the second microphone interposed between the first microphone and the third microphone.

4. The headset of claim 3, wherein a distance between the second microphone and the third microphone is longer than a distance between the first microphone and the second microphone.

5. The headset of claim 1, further comprising a power supply controller configured to turn off a power supply of the headset when the power supply controller detects a rotation of the arm portion to a position where the arm portion overlaps the headband by rotation of the arm portion with respect to the housing.

6. The headset of claim 1, further comprising a power supply controller configured to turn on on a power supply of the headset when the power supply controller detects a rotation of the arm portion to a position where the arm portion protrudes to a side opposite to the first end of the headband with the housing interposed between the arm portion and the headband by rotation of the arm portion with respect to the housing.

* * * * *